US010641297B2

(12) United States Patent
Webel et al.

(10) Patent No.: US 10,641,297 B2
(45) Date of Patent: May 5, 2020

(54) HYDRAULIC CONTROL VALVE

(71) Applicant: Robert Bosch GmbH, Stuttgart (DE)

(72) Inventors: Roger A. Webel, Copley, OH (US); Evan D. Bialosky, Greenville, SC (US); Scott C. Graham, Jeromesville, OH (US); Frank C. Karsten, Wooster, OH (US); Daniel S. Lacey, Wooster, OH (US); Richard F. Sailer, Jr., Massillon, OH (US)

(73) Assignee: Robert Bosch GmbH

( * ) Notice: Subject to any disclaimer, the term of this patent is extended or adjusted under 35 U.S.C. 154(b) by 0 days.

(21) Appl. No.: 16/104,423

(22) Filed: Aug. 17, 2018

(65) Prior Publication Data

US 2020/0056635 A1 Feb. 20, 2020

(51) Int. Cl.

| | |
|---|---|
| ***F15B 13/04*** | (2006.01) |
| ***F15B 13/02*** | (2006.01) |
| ***F15B 1/26*** | (2006.01) |

(52) U.S. Cl.

CPC ..... *F15B 13/0417* (2013.01); *F15B 1/26* (2013.01); *F15B 13/026* (2013.01); *F15B 13/0401* (2013.01); *F15B 2013/0413* (2013.01)

(58) Field of Classification Search

CPC ..... F15B 13/0417; F15B 1/26

See application file for complete search history.

(56) References Cited

U.S. PATENT DOCUMENTS

| | | | | |
|---|---|---|---|---|
| 4,033,236 | A | 7/1977 | Johnson et al. | |
| 4,154,262 | A * | 5/1979 | Blume | F15B 11/163 137/596.2 |
| 4,695,230 | A | 9/1987 | Taplin | |
| 8,020,485 | B2 * | 9/2011 | Jessen | F15B 11/028 91/435 |
| 8,453,783 | B2 * | 6/2013 | Hamkins | E02F 9/2225 180/306 |
| 8,464,758 | B2 * | 6/2013 | Breunig | F15B 13/0402 137/625.69 |
| 9,353,770 | B2 * | 5/2016 | Fukumoto | F15B 11/162 |
| 9,382,923 | B2 * | 7/2016 | Carlin | F15B 1/04 |
| 9,797,419 | B2 * | 10/2017 | Rantanen | F15B 21/14 |
| 9,874,884 | B2 * | 1/2018 | Knapper | G05D 16/106 |
| 2010/0300086 | A1 * | 12/2010 | Buttner | E02F 9/2232 60/420 |
| 2017/0328380 | A1 * | 11/2017 | Coolidge | F15B 11/055 |

* cited by examiner

*Primary Examiner* — Thomas E Lazo

(74) *Attorney, Agent, or Firm* — Michael Best & Friedrich LLP

(57) ABSTRACT

A new means of achieving a valve float position in a closed centered hydraulic control valve. The valve has a main spool position whereby pressure compensator load sense control pressure is drained to tank through the main spool. Secondly, a pin acts on the pressure compensator to prevent the main pump flow from reaching the main section spool. Finally, the new spool position adds a connection from the consumer to tank, enabling a float position.

13 Claims, 1 Drawing Sheet

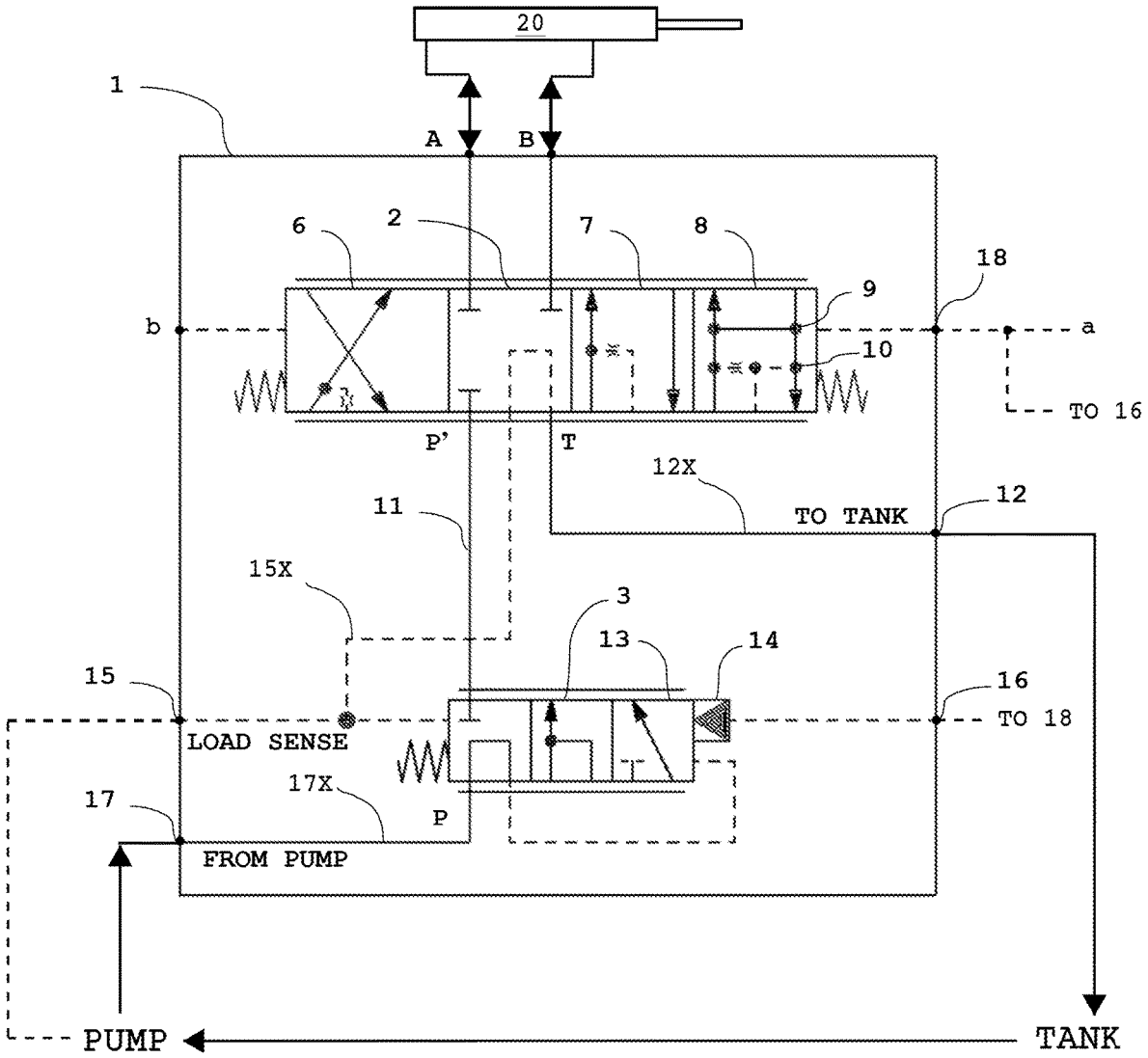
20
1
A
B
6
2
7
8
18
9
b
a
10
TO 16
P'
T
12X
TO TANK
12
11
15X
3
13
14
15
16
TO 18
LOAD SENSE
17X
17
P
FROM PUMP
PUMP
TANK

HYDRAULIC CONTROL VALVE

BACKGROUND

The present invention relates to closed centered hydraulic control valves with pressure compensation for use with a variable displacement pump in a work machine.

SUMMARY

Pressure compensation in closed centered hydraulic control valves provides load independent flow control through the valve. A method of valve pressure compensation is to provide a pressure compensator in line before the main valve spool. The valve pressure compensator can provide a relatively constant pressure drop across the main valve spool. With a relatively constant pressure drop across the spool, flow is controlled by area of spool opening, not by the pressure required at the consumer. Flow volume then is controlled by the area of spool opening such that a larger opening results in a larger flow, and a smaller opening results in a smaller flow.

Two features control the area of spool opening to the consumer. One feature is the size of the radial opening. The radial opening can be as small as a notch or as large as a full radial opening. Flow through the radial opening is controlled by the depth of the opening as measured from the outside diameter of the spool to the diameter at the base of the spool land. The second feature that limits the spool opening to the consumer is the axial distance of the spool movement. This axial movement of the spool opening is referred to as the spool stroke. Spool stroke is normally limited to the distance from the outer radius of the spool to the radius at the base of the spool lands.

A limitation of closed centered hydraulic control valves with pressure compensation is maximum flow to a consumer. As previously mentioned, maximum flow is limited by spool stroke. Within the spool stroke, different features may be connected and controlled. A known combination is a spool design where a power position (flow to the consumer from the pump) occurs in the first half of the valve spool stroke, and float (flow from the consumer to tank) occurs at a second position, or full stroke. This added valve position is referred to as a fourth position. These two features can be used to control a set of lifting arms. The first valve spool position acts to raise (or lower) the arms, and the second full stroke position is float, which acts to allow the arms to freely raise or lower. Float position is used for example with a snowplow blade, so that the blade can freely raise and lower to follow the contour of the ground during travel. For the implement to be free to raise and lower, first, the pump from the power position is isolated from the consumer, and second, the same consumer port is connected to both tank and the second consumer port. This invention eliminates the need to include physical features on the valve spool that provide the logic to shut off the pump to the consumer in the fourth position. Therefore, the spool has more space for additional or larger spool openings. With an increase of spool openings, the maximum flow to the consumer can be increased, even maximum flow in both directions (raise and lower of the arms).

The invention can provide a means of isolating the pump flow from the pump to the valve spool. Accordingly, the valve spool does not require a feature to isolate the pump. This allows more of the valve spool design to be used for additional flow of that same section, increasing efficiency and power of the said valve function.

In accordance with the invention, pump flow can be isolated within the valve section. Pump flow must be isolated along two communication pathways. First, the main pump line must be shut off from the valve spool. Second, the actual load of the consumer must not be communicated to the pressure compensator.

Accordingly, for the first step in the isolation of pump flow, the main pump line is blocked off from the valve spool. For this isolation, the pressure compensator has an added feature. The added feature is a spool pin. This spool pin acts to hold the pressure compensator in the fully closed position during pump isolation. In the fully closed position, communication of flow between the pump and the valve function is prevented.

Accordingly, for the second step in the isolation of pump communication, the valve section load sense signal is dropped below the load of the consumer. For this isolation, the valve section load sense channel (or "signal") is drained to tank. The drain to tank of the load sense signal can be realized by a feature added to the main spool. The feature added to the main spool is a connection of the load sense signal to tank during pump flow isolation.

The invention provides, in one aspect, a pressure compensated hydraulic control valve including a pair of consumer workports for attachment to a hydraulic implement, a pump port for attachment to a variable displacement pump, a tank port for attachment to a hydraulic fluid tank, and a main valve spool. The main valve spool includes passages to selectively connect a pressure compensated pump flow channel from the pump port, a tank channel to the tank port, a variable displacement pump load sense channel, and the pair of consumer workports. The main valve spool includes a neutral spool position in which the pressure compensated pump flow channel is blocked and the variable displacement pump load sense channel is connected to the tank channel. The main valve spool includes a first power position connecting the pressure compensated pump flow channel to the first one of the pair of consumer workports, connecting the first one of the pair of consumer workports to the variable displacement pump load sense channel, and connecting a second one of the pair of consumer workports to the tank channel. The main valve spool includes a second power position connecting the pressure compensated pump flow channel to the second one of the pair of consumer workports, connecting the second one of the pair of consumer workports to the variable displacement pump load sense channel, and connecting the first one of the pair of consumer workports to the tank channel. The main valve spool includes a fourth spool position connecting both of the pressure compensated pump flow channel and the tank channel to both of the pair of consumer workports, the fourth spool position further connecting the variable displacement pump load sense channel to the tank channel.

The invention provides, in another aspect, a method of operating a work machine with a pressure compensated hydraulic control valve. Hydraulic fluid is supplied from a variable displacement pump through a pump port, a pressure compensator, and a pressure compensated pump flow channel to a valve spool inlet of a main valve spool. The main valve spool is moved from a neutral position to a first power position to connect the pressure compensated pump flow channel to a first one of a pair of consumer workports, to connect the first one of the pair of consumer workports to a variable displacement pump load sense channel, and to connect a second one of the pair of consumer workports to a tank channel. The main valve spool is moved from the neutral position to a second power position to connect the pressure compensated pump flow channel to the second one of the pair of consumer workports, to connect the second one of the pair of consumer workports to the variable displacement pump load sense channel, and to connect the first one of the pair of consumer workports to the tank channel. The main valve spool is moved from the second power position to a float position to connect both of the pressure compensated pump flow channel and the tank channel to both of the pair of consumer workports, and to connect the variable displacement pump load sense channel to the tank channel.

BRIEF DESCRIPTION OF THE DRAWING

The FIGURE is a schematic view of a pressure compensated hydraulic control valve according to one embodiment of the present invention.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Referring now to the sole drawing, a hydraulic control valve 1 is shown. The hydraulic control valve 1 is a closed centered hydraulic control valve with pressure compensation. The valve 1 may be part of a hydraulic system adapted for use on a machine. The system having the control valve 1 also includes a variable displacement pump of any suitable construction such as that disclosed in U.S. Pat. No. 4,695,230 issued Sep. 22, 1987 to Lael B. Taplin, incorporated by reference herein. Internal to the control valve 1, known features of a closed centered hydraulic control valve with pressure compensation can be provided, for example, a construction such as that disclosed in U.S. Pat. No. 4,033,236 issued Jul. 5, 1977 to Howard L. Johnson and John A. Junck, incorporated by reference herein, among other suitable constructions. It is also noted that the control valve 1 is not necessarily the only control valve of the system. As such, control valves 1 with or without the inventive features set forth below may be provided in parallel for several functions on a machine. Further, what is shown as a direct connection between the variable displacement pump and the control valve 1 at the inlet port 17 may in fact be an indirect connection with one or more additional valves therebetween.

The control valve 1 consists of two primary items. The first item is a main valve spool 2, shown in the neutral position. The second item is a flow-controlling pressure compensator spool 3, shown in the neutral position. The main valve spool 2 is connected by a connection passage or delivery passage 11 to the pressure compensator spool 3. Basic functions of the control valve 1 can be similar to those described in detail in U.S. Pat. No. 4,033,236. The variable displacement pump supplies pressurized fluid to the inlet port 17 and the internal control valve passage, or "pump channel" 17X, extending therefrom. The pressure compensated flow control valve spool 3 is operative in response to load pressure, conveyed via load sense valve port 15, load sense channel 15X, and pump pressure. The pressure compensator spool 3 controls the flow of fluid between the inlet port 17 or pump channel 17X, and the delivery passage 11 to the main control spool 2. The delivery passage 11 can also be referred to as the pressure compensated pump flow channel to the main valve spool 2. The main valve spool 2 directs the flow of fluid between the passage 11 and passages or channels extending to the respective workports A, B for connection to the consumer(s) 20 (e.g., hydraulic cylinder). The main valve spool 2 is provided with passages in positions 6 and 7 to direct the flow accordingly. By shifting the main valve spool 2 (to the right as shown, by the "b" spool shift signal) from the neutral position to position 6, workport B is powered by the pump, and workport A is connected to low pressure tank (via tank channel 12X of the control valve 1 and ultimately the tank port 12) to drain. Likewise, shifting the main valve spool 2 (to the left as shown, by the "a" spool shift signal) from the neutral position to position 7, workport A is powered by the pump, and workport B is connected to tank. Each of the power positions 6, 7 also include an internal connection between the powered workport and the load sense 15X to provide the feedback for controlling the position of the pressure compensator spool 3.

In addition to the basic operational features, the control valve 1 further includes a spool pin 14 on the pressure compensator spool 3, and a main valve spool float position 8. The float position 8 consists of two main valve spool float position features added in addition to the features of position 7. The first added feature to the main valve spool 2 is a connection 9 from workport A to the tank port 12. The second added feature is a connection 10 of the load sense channel 15X to the tank port 12.

In order to achieve pump isolation position 13, main valve spool float position 8 and spool pin 14 initiated simultaneously. One possible method to operate them simultaneously is to connect passages 16 and 18, which are incident on the respective spools 3, 2. In order for this connection to function properly, "a" spool shift signal pressure in passage 18 must be high enough to bias the pressure compensator spool 3 to a main pump isolation position 13. Once the spool item 2 is biased to float position 8, the load sense channel 15X is connected to low pressure tank via tank channel 12X (and tank port 12), helping to create the bias to shift the pressure compensator spool 3 to the main pump isolation position 13.

The function of the float position 8 is described as follows. As "a" spool shift signal pressure is applied to 18, the main valve spool 2 moves from the neutral condition to power position 7. The main valve spool power position 7 provides maximum flow to the first workport A. With an increase of "a" spool shift signal pressure applied to passage 18, the main valve spool float position 8 can be realized. The float position 8 also establishes a first connection 9 between the first workport A and the tank channel 12X, and a second connection 10 between the load sense channel 15X and the tank channel 12X. Connection 9 is a flow path from consumer 20 at workport A that enables flow to and from the tank, further enabling a float type function (consumer workport B remains connected to the tank channel 12X through the conventional passages as found in position 7). The second connection 10 unloads the load sense channel 15X to tank 12 (via passage 12X), providing opportunity for the spool pin 14 to bias the pressure compensator spool 3 to the main pump isolation position 13.

The spool pin 14 is a pin which, when acted on by pressure in 16 can provide bias so that the pressure compensator spool 3 may achieve pump isolation position 13. The spool pin 14 provides a force on the end of the pressure compensator spool 3 that is separate from that incident on the pressure compensator spool 3 from the connection to pump inlet P to the pressure compensator spool 3. The spool pin 14 can also apply force to the pressure compensator spool 3 from the passage 16 in a force multiplied manner (i.e., the force applied by the spool pin 14 is equal to a force generated directly by the fluid in the passage 16, multiplied by a factor greater than 1). Furthermore, as previously discussed, simultaneous draining of load sense channel 15X to tank provides bias from the spool pin 14 to bias the pressure compensator spool 3 to the pump isolation position 13. Thus, the position 13 isolates the delivery passage 11 and main valve spool pump inlet P' from the main variable displacement pump 17.

Various features and advantages of the invention are set forth in the following claims.

What is claimed is:

1. A pressure compensated hydraulic control valve comprising:

a pair of consumer workports for attachment to a hydraulic implement;

a pump port for attachment to a variable displacement pump;

a tank port for attachment to a hydraulic fluid tank;

a main valve spool including passages to selectively connect a pressure compensated pump flow channel from the pump port, a tank channel to the tank port, a variable displacement pump load sense channel, and the pair of consumer workports, wherein the main valve spool includes:

a neutral spool position in which the pressure compensated pump flow channel is blocked and the variable displacement pump load sense channel is connected to the tank channel, a first power position connecting the pressure compensated pump flow channel to a first one of the pair of consumer workports, connecting the first one of the pair of consumer workports to the variable displacement pump load sense channel, and connecting a second one of the pair of consumer workports to the tank channel, a second power position connecting the pressure compensated pump flow channel to the second one of the pair of consumer workports, connecting the second one of the pair of consumer workports to the variable displacement pump load sense channel, and connecting the first one of the pair of consumer workports to the tank channel, and a fourth spool position connecting both of the pressure compensated pump flow channel and the tank channel to both of the pair of consumer workports, the fourth spool position further connecting the variable displacement pump load sense channel to the tank channel;

a pressure compensator spool including passages to control output to a valve spool inlet of the main valve spool from the pump port that supplies flow from the variable displacement pump, wherein a connection from the load sense channel and a connection from the pump port act together to maintain a pressure drop from the pump port to the load sense channel; and a spool pin positioned to act on and urge the pressure compensator spool toward a position in which the pressure compensator spool blocks communication between the pump port and the valve spool inlet of the main valve spool, the spool pin being exposed to a first hydraulic fluid passage that acts on the spool pin separate from the connection to the pressure compensator spool from the pump port that acts together with the connection from the load sense channel to maintain the pressure drop from the pump port to the load sense channel.

2. The pressure compensated hydraulic control valve of claim 1, wherein the connection from the pump port, which acts along with the connection from load sense channel on the pressure compensator spool, is internal to the pressure compensator spool.

3. The pressure compensated hydraulic control valve of claim 1, wherein the first hydraulic fluid passage that acts on the spool pin is in communication with a second hydraulic fluid passage extending to an end of the main valve spool.

4. The pressure compensated hydraulic control valve of claim 3, wherein the fourth spool position is defined at the end of the main valve spool.

5. The pressure compensated hydraulic control valve of claim 1, wherein in the fourth spool position, the connection of both of the pressure compensated pump flow channel and the tank channel to both of the pair of consumer workports is within the main valve spool.

6. The pressure compensated hydraulic control valve of claim 5, wherein in the fourth spool position, the connection between the variable displacement pump load sense channel and the tank channel is within the main valve spool.

7. The pressure compensated hydraulic control valve of claim 1, wherein the main valve spool is biased to the neutral position.

8. A method for operating a work machine with a pressure compensated hydraulic control valve, the method comprising:

supplying hydraulic fluid from a variable displacement pump through a pump port, a pressure compensator, and a pressure compensated pump flow channel to a valve spool inlet of a main valve spool;

moving the main valve spool from a neutral position to a first power position to connect the pressure compensated pump flow channel to a first one of a pair of consumer workports, to connect the first one of the pair of consumer workports to a variable displacement pump load sense channel, and to connect a second one of the pair of consumer workports to a tank channel;

moving the main valve spool from the neutral position to a second power position to connect the pressure compensated pump flow channel to the second one of the pair of consumer workports, to connect the second one of the pair of consumer workports to the variable displacement pump load sense channel, and to connect the first one of the pair of consumer workports to the tank channel;

moving the main valve spool from the second power position to a float position to connect both of the pressure compensated pump flow channel and the tank channel to both of the pair of consumer workports, and to connect the variable displacement pump load sense channel to the tank channel; and simultaneous with moving the main valve spool to the float position, moving a pressure compensator spool to a pump isolation position that blocks the valve spool inlet of the main valve spool from the pump port that supplies flow from the variable displacement pump.

9. The method of claim 8, wherein the spool of the pressure compensator is moved to the pump isolation position by a spool pin.

10. The method of claim 9, wherein the spool pin is acted upon by hydraulic fluid in a first passage that is in communication with a second passage extending to an end of the main valve spool that defines the float position of the main valve spool.

11. The method of claim 8, wherein both of the pressure compensated pump flow channel and the tank channel are connected to both of the pair of consumer workports within the main valve spool float position.

12. The method of claim 8, wherein the variable displacement pump load sense channel and the tank channel are connected within the main valve spool float position.

13. The method of claim 8, wherein moving the main valve spool from the neutral position includes overcoming a bias force on the main valve spool.

* * * * *